US005709065A

United States Patent [19]

Krause

[11] Patent Number: 5,709,065

[45] Date of Patent: Jan. 20, 1998

[54] DESICCANT SUBSTRATE PACKAGE

[75] Inventor: Michael Krause, Colorado Springs, Colo.

[73] Assignee: Empak, Inc., Chanhassen, Minn.

[21] Appl. No.: 688,723

[22] Filed: Jul. 31, 1996

[51] Int. Cl.[6] ..... B65B 29/00; B65B 31/02; B65B 63/08

[52] U.S. Cl. ..... 53/400; 53/432; 53/440; 53/449; 53/127; 53/173; 53/510; 206/204; 206/711

[58] Field of Search ..... 206/204, 710, 206/711, 712, 454; 53/400, 432, 449, 173, 141, 440, 127, 510

[56] References Cited

U.S. PATENT DOCUMENTS

| | | | |
|---|---|---|---|
| 2,283,867 | 5/1942 | Flosdorf et al. . | |
| 3,833,406 | 9/1974 | White | 206/204 X |
| 3,834,606 | 9/1974 | Andersson | 206/204 X |
| 4,036,360 | 7/1977 | Deffeyes | 206/204 |
| 4,160,504 | 7/1979 | Kudlich et al. | 206/711 |
| 4,553,020 | 11/1985 | Val . | |
| 4,603,538 | 8/1986 | Shave . | |
| 4,721,207 | 1/1988 | Kikuchi | 206/711 X |
| 4,899,883 | 2/1990 | Weber et al. . | |
| 4,919,984 | 4/1990 | Maruhashi | 206/204 X |
| 4,966,284 | 10/1990 | Gregerson et al. . | |
| 5,222,307 | 6/1993 | Oba et al. . | |
| 5,228,567 | 7/1993 | Itoh | 206/204 X |
| 5,240,753 | 8/1993 | Tabuchi et al. | 206/711 X |
| 5,260,023 | 11/1993 | Evans, II . | |
| 5,274,914 | 1/1994 | Kitamura et al. . | |
| 5,287,962 | 2/1994 | Nomi et al. . | |
| 5,346,518 | 9/1994 | Baseman et al. | 206/711 X |
| 5,398,481 | 3/1995 | Takeuchi et al. . | |
| 5,464,580 | 11/1995 | Popescu et al. . | |

FOREIGN PATENT DOCUMENTS

| | | | |
|---|---|---|---|
| 458423 | 11/1991 | European Pat. Off. | 206/204 |
| 3289481 | 12/1991 | Japan | 206/204 |
| 5338639 | 12/1993 | Japan | 206/204 |

OTHER PUBLICATIONS

"Desiccant Doubles as Mechanical Component", Chemical Engineering, Jul. 1970.

*Primary Examiner*—Linda Johnson
*Attorney, Agent, or Firm*—Haugen and Nikolai, P.A.

[57] ABSTRACT

A method for protecting substrates used in the manufacture of semiconductors, memory products, and other electronic devices from the effects of moisture during transport and storage is disclosed. This method involves the use of a cassette or box made from polycarbonate or another material having similar hydroscopic properties, treating the cassette or box to reduce its moisture content, and surrounding the cassette or box, and the substrates held therein, with a moisture barrier. This results in a package which will keep the substrates dry and eliminates the need for a separate desiccant within the package.

20 Claims, 6 Drawing Sheets

DESICCANT SUBSTRATE PACKAGE

BACKGROUND OF THE INVENTION

I. Field of the Invention

The present invention relates to packaging for storing and shipping substrates used in the manufacture of semiconductors, memory products and other electronic devices. More specifically, the present invention relates to packaging which protects such substrates and electronic devices from the harmful effects of moisture during transport and storage.

II. Description of the Prior Art

Substrates used in the manufacture of semiconductors, memory products, and electronic devices tend to be very fragile and sensitive. Manufacturing of such devices is generally done in clean room environments. Much research and development has gone into the design of substrate handling equipment as well as transport carriers and packages for such substrates. Much of this research and development revolves around steps which can be taken to protect the substrate and prevent physical damage. See, for example, U.S. Pat. No. 5,398,481 granted on Mar. 21, 1995 to Takeuchi et al.

Substrates used in the manufacture of semiconductor and memory products can be damaged in a variety of ways. They are easily scratched, cracked or chipped. Very significant problems can arise from chemical reactions which can occur when such items are stored in the presence of moisture.

Various packaging techniques have been used to prevent the problems associated with moisture. For example, U.S. Pat. No. 4,553,020 issued on Nov. 12, 1985 to Val describes a hermetically sealed, encapsulation package for electronic components and integrated circuits. This packaging includes a base and cover. The base includes a separate moisture retention element which retains any water molecules remaining within the package after sealing or which may enter the package through a leak. This retention element is made of an absorbent and porous glass type material in the zeolite group capable of retaining water molecules. Alternatively, the retention element can be formed by a material which reacts chemically with water. Examples cited in the Val patent include silicon, titanium, zirconium, tantalum, vanadium, aluminum and tin. In each case, supplying power to the moisture retaining element is used to improve its performance. In the case of zeolite, applying power constitutes a degassing treatment which reduces the water molecules in the moisture retaining element to a minimum. In the case of the other materials listed above, using power to heat the moisture retaining element at predetermined intervals after closure of the package ensures that the atoms of the reactive metal diffuse toward the surface and through any oxide layer which has already been formed to renew the moisture retaining capacity of the moisture retaining element.

Another example of a technique developed to protect substrates and related electronics devices from moisture is described in U.S. Pat. No. 5,274,914 which issued on Jan. 4, 1994 to Kitamura et al. In this patent, the item to be packaged, along with a silica gel desiccant, is place inside a moisture-proofing bag which is heat-sealed. The bag can be made of a laminate film having a polyethylene layer, a polyester layer, a carbon conductive layer, an acrylic resin layer, and a vinylidene chloride layer. The bag is, of course, sealed before intrusion of moisture occurs.

U.S. Pat. No. 5,287,962, which issued to Nomi et al on Feb. 22, 1994, also represents an effort to deal with the susceptibility of semiconductors to moisture because of the permeability of the molding compounds. The Nomi patent describes a packaging medium which consists of a shipping means for carrying a semiconductor device, a flexible dry-pack bag for containing the shipping means, and a vacuum seal indicator. The devices to be packaged are baked until dry just prior to packaging. The dry-pack bag is vacuum-sealed around the device to be packaged. No desiccant is provided. This system relies on the assumption that the device is dry before it is placed in the package and will remain dry as long as the vacuum seal is not broken.

Each of the systems recognize the need for substrates and associated electronic devices to be kept dry. The Val and Kitamura patents utilize separate desiccants which can serve to increase processing and packaging costs or serve as a contaminant. A real need exists for a substrate packaging system which is economical and does not introduce any potential contaminants which could damage the substrate.

SUMMARY OF THE INVENTION

One object of the present invention is to provide an economical substrate packaging system which is capable of reducing the adverse effects of moisture.

A further object of the present invention is to provide such a packaging system which controls moisture levels without the use of a separate desiccant.

Another object of the present invention is to provide a packaging system which can contain a plurality of substrates in a protected fashion in a moisture-controlled environment.

These and other objects are achieved by providing a packaging system consisting of a cassette and a sealable bag. The cassette is preferably made of polycarbonate or some other durable material having similar hydrophilic characteristics. The sealed bag provides a moisture-proof barrier. The system also requires some suitable means for drying the cassette prior to use so that the material of the cassette acts as a desiccant during transport and storage of substrates in the package. Such means could include a source of warm air, a source of nitrogen, a vacuum chamber, or the like.

One packaging method contemplated by the invention would be to dry the cassette to reduce the moisture content of the material from which the cassette is made. When sufficiently dried, the substrates are loaded into the cassette and the cassette and substrates are sealed inside the bag. Another method contemplated by the invention involves loading the substrates into the cassette, drying the cassette, and then sealing the cassette inside the bag. Still another method might involve the use of a cassette consisting of a wafer carrier and a separate box, either or both of which can be dried and thus prepared to serve as a desiccant before being sealed in the bag with the substrates.

BRIEF DESCRIPTION OF THE DRAWINGS

The features and advantages of the present invention will become better understood from the following detailed description read in conjunction with the accompanying drawings. In the drawings.

DESCRIPTION OF THE PREFERRED EMBODIMENTS

Figure 1:
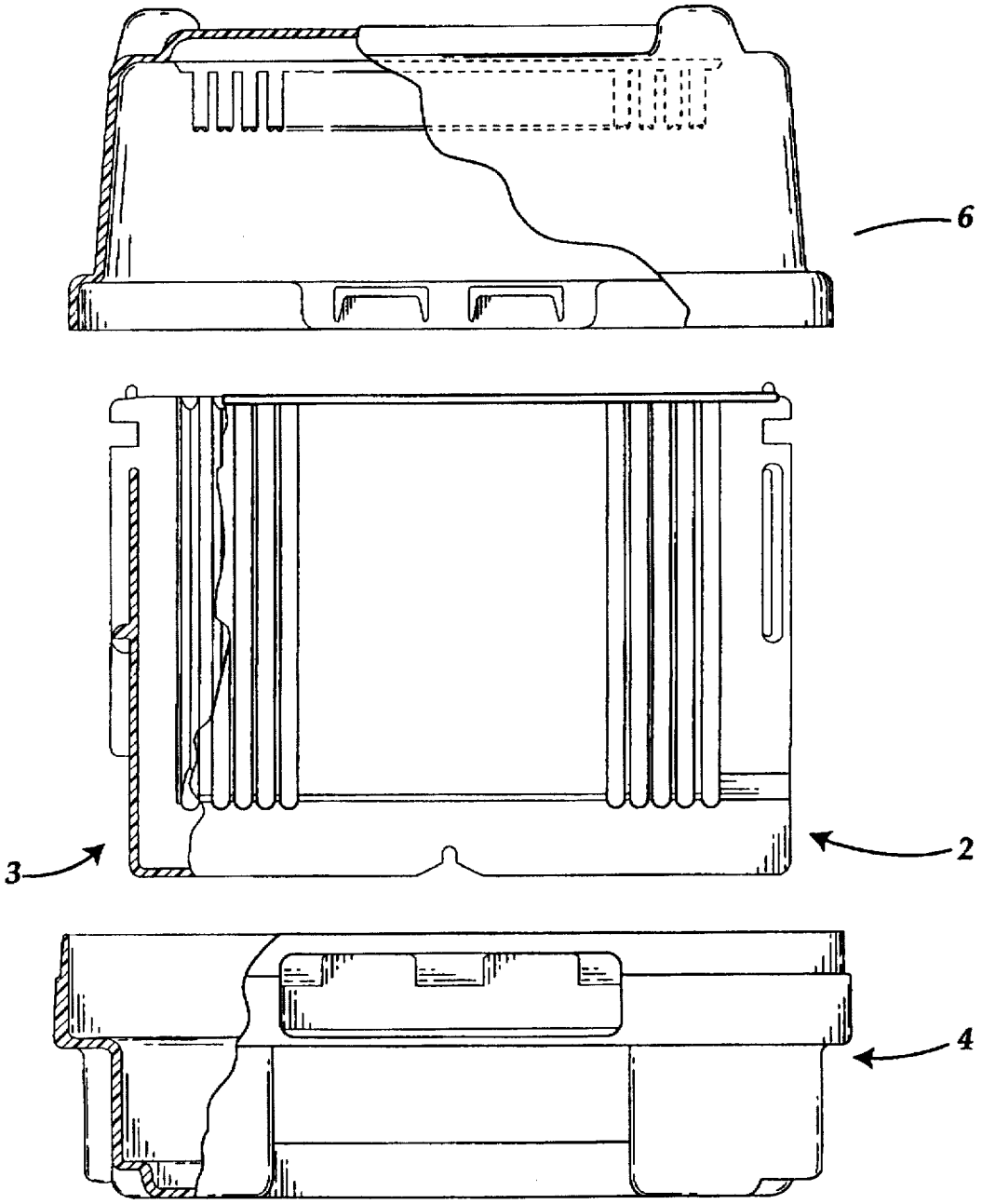
FIG. 1 is an exploded view showing a substrate carrier and a box.

FIG. 1 illustrates a typical prior art packaging system used to store and transport substrates. This packaging system includes a substrate carrier 2 and a box 3 having a bottom 4 and a top 6. The box 3 is designed to hold the substrate carrier 2 and any substrates held therein. Further information related to the packaging system shown in FIG. 1 can be found in U.S. Pat. No. 4,966,284 which issued on Oct. 30, 1990 in the name of Gregerson et al.

Those skilled in the art will recognize that the prior art also includes the use of substrate carriers, like carrier 2 shown in FIG. 1, without a separate box. Likewise, the prior art includes boxes designed to hold substrates without the need for a separate carrier. Throughout this application, the term "cassette" is used generically to cover substrate carriers used separately or with a box and boxes used separately or with a carrier. As used herein, the word "cassette" is intended to cover any portable device designed to hold and protect one or more substrates during transport or storage.

The purpose of the present invention is to protect substrates from the harmful effects of moisture during transport and storage. This is achieved by making the cassette, or at least a part thereof, out of a hydrophilic plastic material. One suitable plastic material is polycarbonate.

Figure 2:
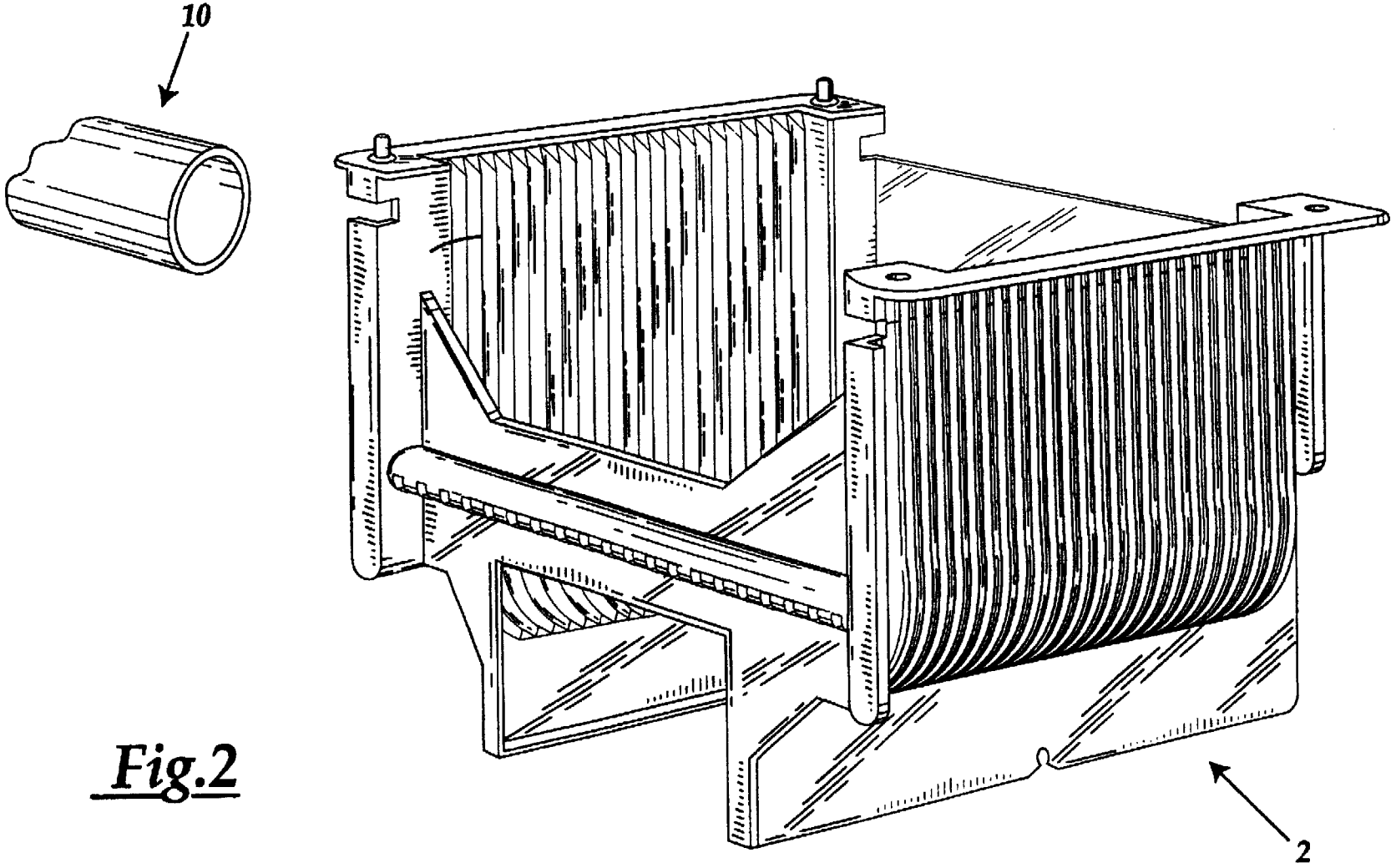
FIG. 2 is a perspective view showing a substrate carrier inside a gas flow desiccating chamber.

Cassettes made out of hydrophilic materials such as polycarbonate can be treated in a number of ways to reduce the moisture content of the material. FIG. 2 shows, by way of example, a substrate carrier 2 in combination with a gas source 10. The gas source 10 can be used to create a flow of gas around the carrier 2 to dry out the hydrophilic material from which the carrier 2 is made. The gas could, for example, be nitrogen or even heated air. Bathing the carrier 2 in such a gas serves to reduce moisture content of the hydrophilic material.

Figure 3:
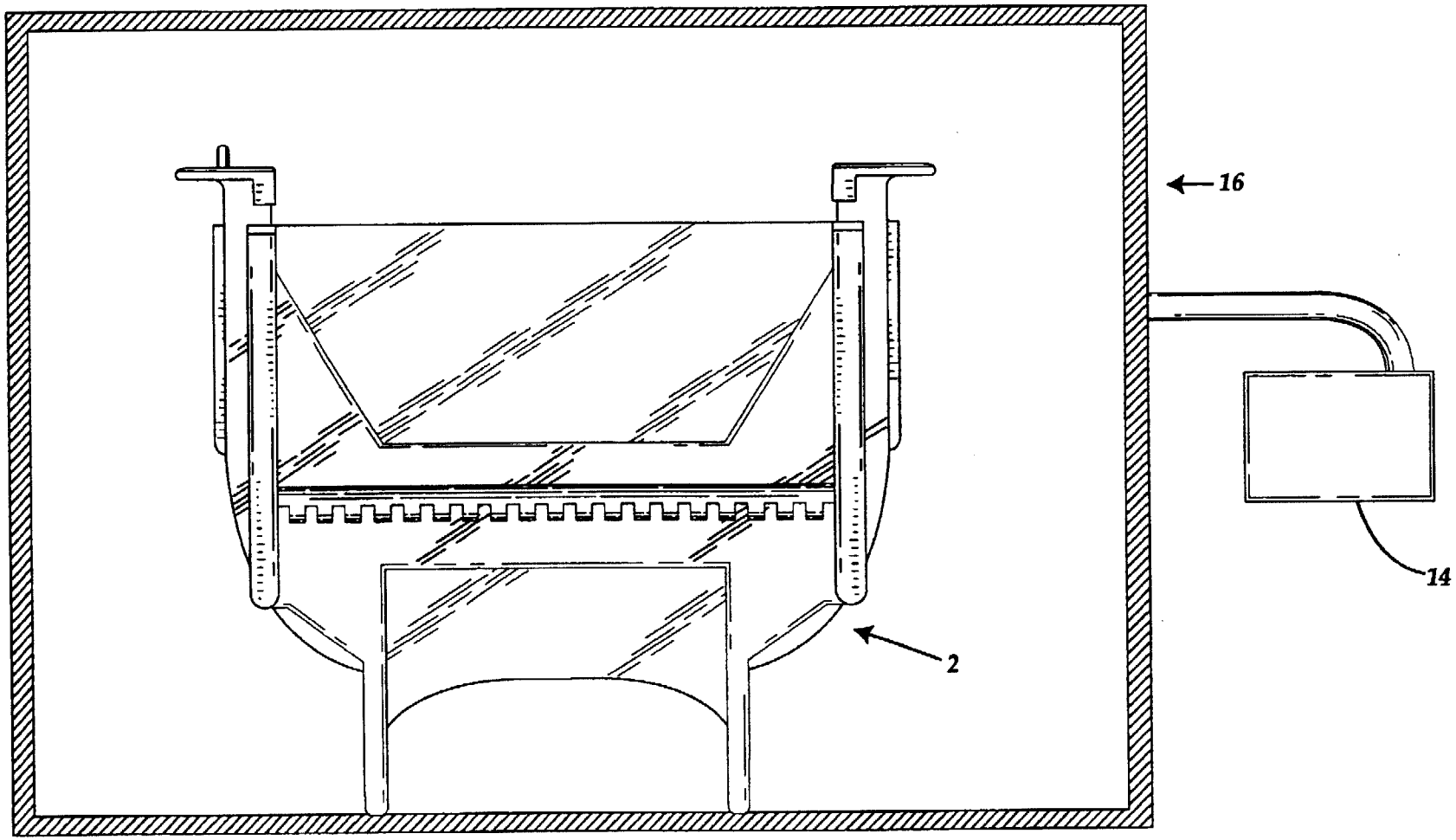
FIG. 3 is a perspective view showing a substrate carrier inside a vacuum chamber.
Figure 4:
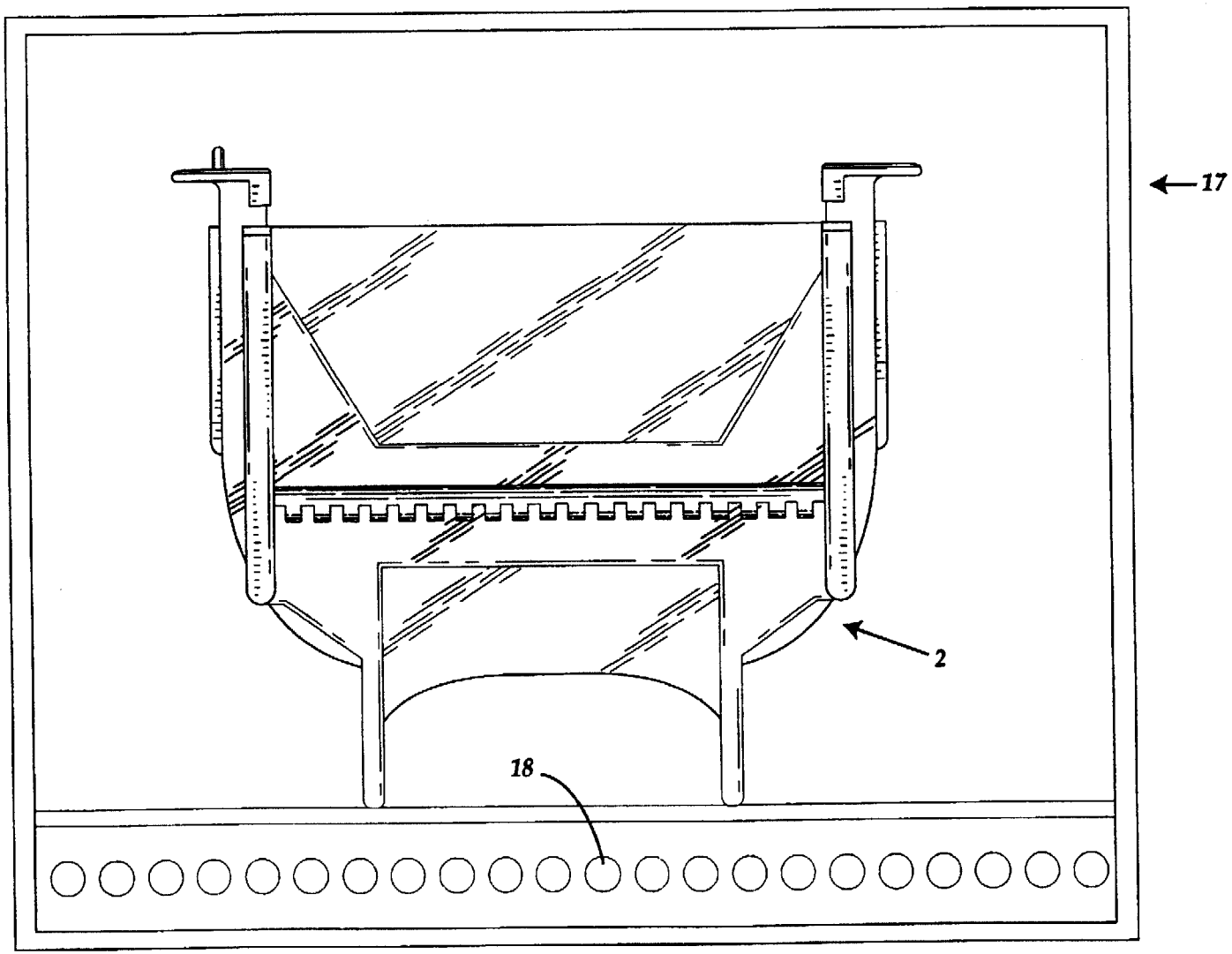
FIG. 4 is a perspective view showing a substrate carrier inside a heating oven.

FIGS. 3 and 4 show alternative techniques for reducing the moisture content of the hydrophilic material from which the carrier 2 is made. The carrier 2, for example, can be placed inside a vacuum chamber 16 as shown in FIG. 3. Evacuation of the chamber 16 using a pump 14 will serve to draw moisture from the hydrophilic material to reduce the total moisture content. The carrier 2 could also be placed in an oven 17 as shown in FIG. 4. Using heating elements 18 to warm the oven 17 to a temperature between 100° F. and 150° F. will serve to reduce the moisture content of the carrier 2. This temperature range, while high enough to draw the moisture out of the hydrophilic plastic material, is not high enough to melt the plastic or otherwise undermine the structural integrity of the carrier 2.

FIGS. 2–4 show the cassette being dried without the substrates in place. This may be preferred to prevent the substrates from being damaged by the drying process. However, the substrates can be present in the cassette during the drying operation as long as the particular drying process used will not adversely affect the substrates. Many substrates can easily withstand temperatures in the 100° F. to 150° F. range and are not adversely affected by nitrogen, warm air or vacuum treatment.

Figure 5:
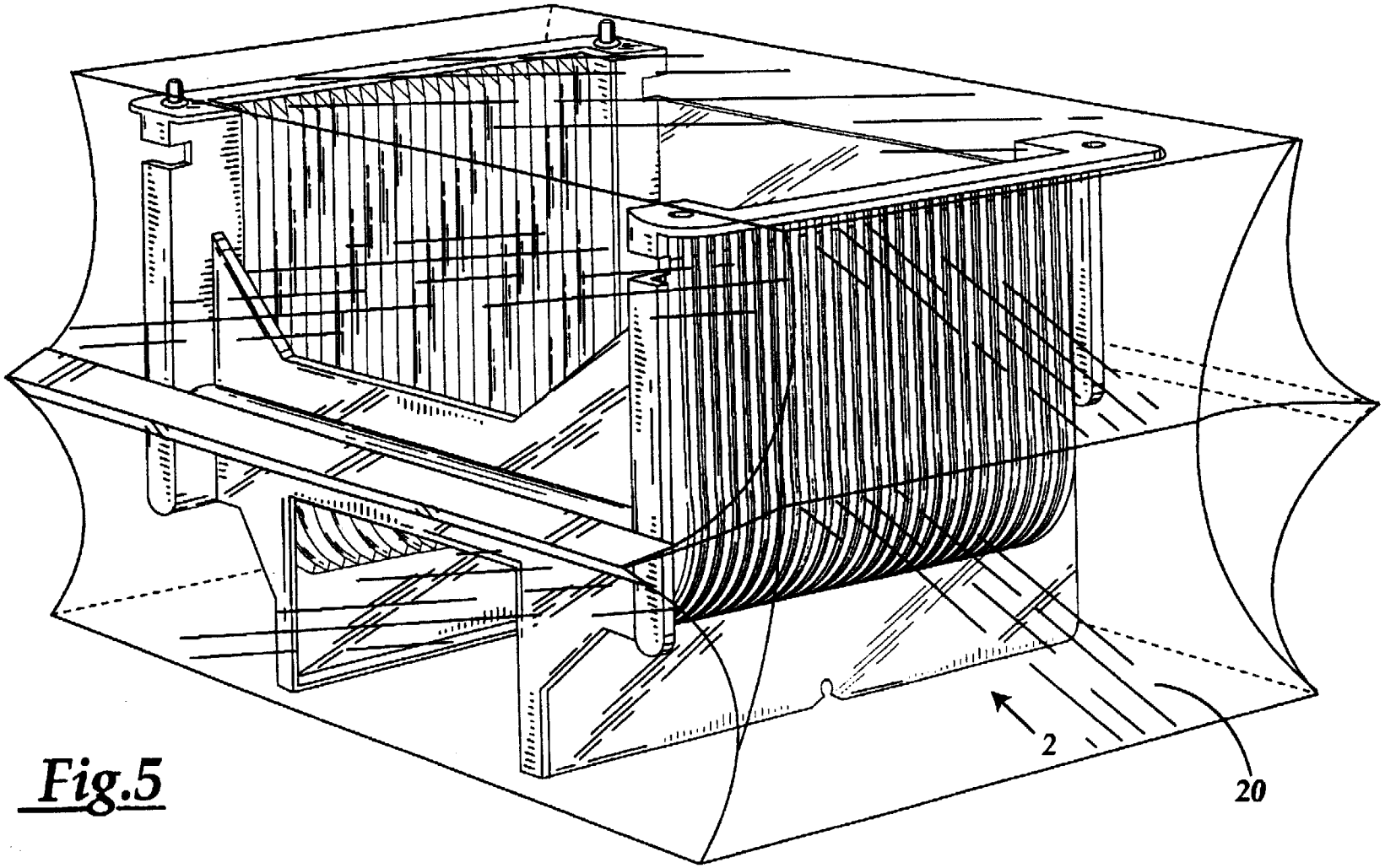
FIG. 5 is a perspective view showing the substrate carrier within a moisture-proof barrier.
Figure 6:
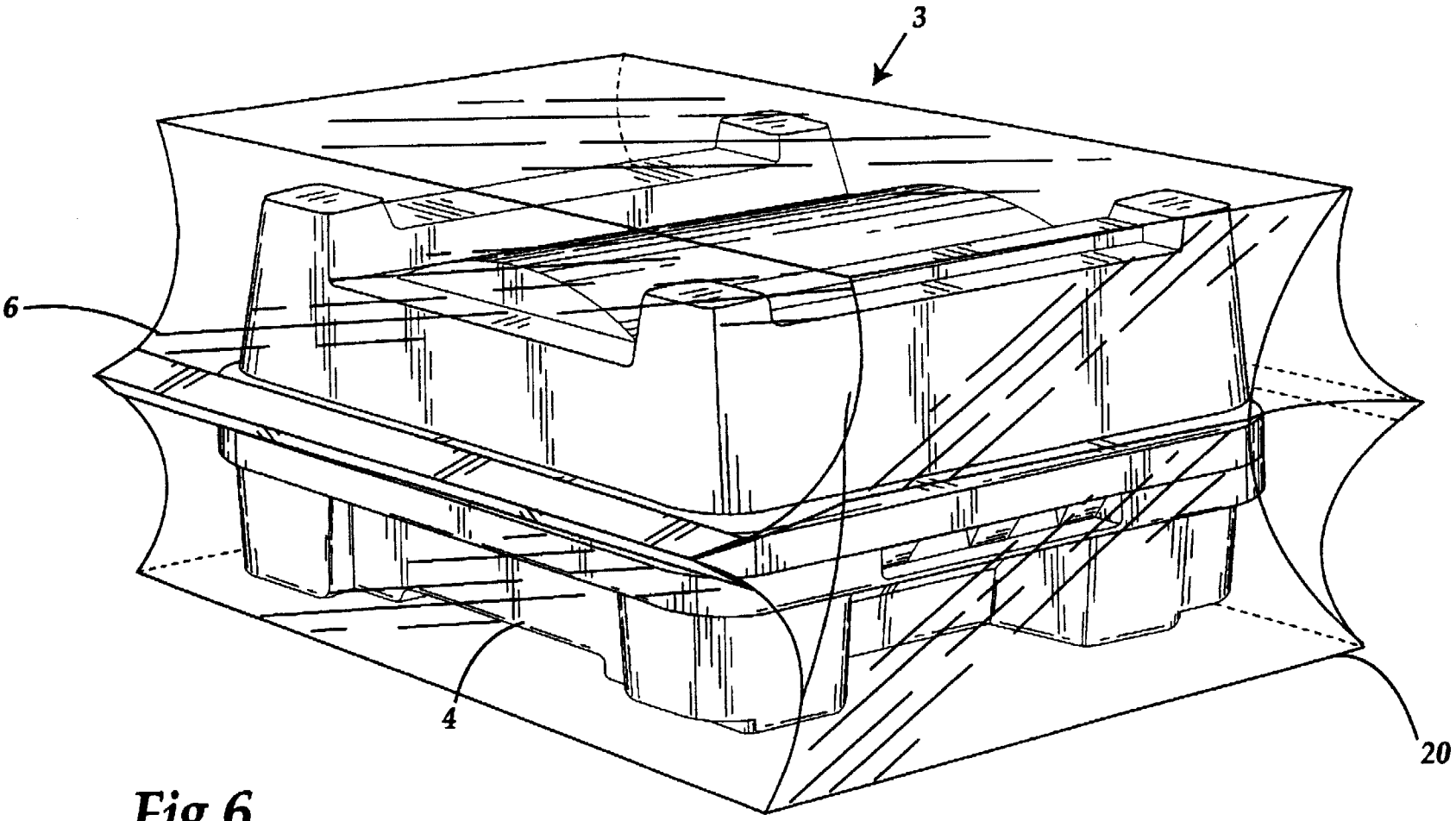
FIG. 6 is a perspective view showing a transport box within a moisture-proof barrier.

FIGS. 5 and 6 each show cassettes surrounded by a moisture-proof barrier 20. This moisture-proof barrier 20 is added after the cassettes have been dried to encapsulate the cassette and its contents. Given this arrangement, the dried cassette acts as a desiccant absorbing any water molecules within the moisture-proof barrier 20. The moisture-proof barrier 20 prevents water molecules from passing through the barrier or at least limits the number of molecules passing through to a level where such molecules will also be absorbed by the cassette.

The moisture-proof barrier 20 can be made of any one of a number of suitable materials. Definite advantages are achieved by using a laminated plastic film which can be heat sealed. One such laminate includes a layer of polyethylene, a layer of polyester, a carbon conductive layer, an acrylic resin layer, and a vinylidene layer.

When the packaging system of the present invention is used, a cassette comprising a substrate carrier 2, or a box 3, or both, is provided. At least a portion of the cassette is made of a hydrophilic plastic material. The material is treated as described above and then is sealed, along with the substrates, in a moisture-proof barrier 20. The substrates may be inserted into the cassette before the cassette is treated or between the treatment of the cassette and encapsulation of the cassette in a moisture-proof barrier 20. When this procedure is used, the cassette acts as a desiccant and works in combination with the moisture-proof barrier 20 to protect the substrates from moisture.

I claim:

1. A package for substrates used in the manufacture of semiconductors and other electronic devices comprising:

(a) a cassette for holding at least one substrate, said cassette made of a hydrophilic plastic material which has been dried to reduce the moisture content of said material;

(b) a sealed, moisture-proof barrier surrounding said cassette and its contents so that moisture inside the barrier is absorbed by the hydrophilic plastic material of the cassette and moisture outside the barrier does not penetrate the barrier.

2. The package of claim 1 wherein said hydrophilic plastic material is polycarbonate.

3. The package of claim 1 wherein said sealed moisture-proof barrier is a bag made of plastic laminate.

4. The package of claim 1 wherein said plastic laminate is comprised of a layer of polyethylene, a layer of polyester, a carbon conductive layer, an acrylic resin layer, and a vinylidene layer.

5. A system for protecting in a single package one or more substrates of the type used in the manufacture of semiconductors and other electronic devices, said system including:

(a) cassette means made of a hydrophilic plastic material for holding at least one substrate;

(b) means for drying said cassette means to reduce the moisture content of said hydrophilic plastic material; and (c) means for forming a moisture-proof barrier around said cassette means and any substrate held in said cassette means.

6. The system of claim 5 wherein said hydrophilic plastic material is polycarbonate.

7. The system of claim 5 wherein said means for drying said cassette means is a nitrogen source.

8. The system of claim 5 wherein said means for drying said cassette means is a source of hot air.

9. The system of claim 5 wherein said means for drying said cassette means is a vacuum chamber.

10. The system of claim 5 wherein said moisture-proof barrier is made of a plastic laminate.

11. The system of claim 5 wherein said moisture-proof barrier is a sealed bag.

12. A method for packaging at least one substrate of the type used in the manufacture of semiconductors and other electronic devices comprising the steps of:

(a) placing the substrates to be packaged into a cassette, said cassette made at least in part from a hydrophilic plastic material;

(b) exposing said cassette to a drying environment to reduce the moisture content of the hydrophilic plastic material;

(c) providing a sealed, moisture-proof barrier around the cassette and the substrates contained therein so that moisture inside the barrier is absorbed by the hydrophilic plastic material from which the cassette is made and moisture outside the barrier does not penetrate the barrier.

13. A method for packaging at least one substrate of the type used in the manufacture of semiconductors and other electronic devices comprising the steps of:

(a) providing a cassette capable of holding at least one substrate, said cassette being made at least in part of a hydrophilic plastic material;

(b) exposing the cassette to a drying environment to reduce the moisture content of said hydrophilic plastic material;

(c) inserting at least one substrate into said cassette after the moisture content of the hydrophilic plastic material has been reduced;

(d) providing a sealed, moisture-proof barrier around the cassette and any substrates contained therein so that moisture inside said barrier is absorbed by the hydrophilic plastic material from which the cassette is made and moisture outside the barrier does not penetrate the barrier.

14. The method of claim 12 or claim 13 wherein said hydrophilic material is polycarbonate.

15. The method of claim 12 or claim 13 wherein said drying environment consists of heated air.

16. The method of claim 12 or claim 13 wherein said drying environment consists of nitrogen.

17. The method of claim 12 or claim 13 wherein said drying environment is a vacuum.

18. The method of claim 12 or claim 13 wherein said drying environment has an atmospheric pressure less than normal atmospheric pressure.

19. The method of claims 12 or 13 wherein said sealed, moisture-proof barrier is made of a plastic laminate.

20. The method of claim 19 wherein said plastic laminate includes a layer of polyethylene, a layer of polyester, a carbon conductive layer, an acrylic resin layer, and a vinylidene layer.

* * * * *